US007374061B2

(12) United States Patent
Næsje

(10) Patent No.: US 7,374,061 B2
(45) Date of Patent: May 20, 2008

(54) SEALING DEVICE FOR A DRINKING CONTAINER

(75) Inventor: Kolbjørn Næsje, Sandnes (NO)

(73) Assignee: Smart Seal AS (NO)

( * ) Notice: Subject to any disclaimer, the term of this patent is extended or adjusted under 35 U.S.C. 154(b) by 221 days.

(21) Appl. No.: 10/895,027

(22) Filed: Jul. 20, 2004

(65) Prior Publication Data

US 2005/0011902 A1 Jan. 20, 2005

Related U.S. Application Data

(63) Continuation of application No. PCT/NO03/00010, filed on Jan. 15, 2003.

(30) Foreign Application Priority Data

Jan. 21, 2002 (NO) ..... 20020302
Jan. 15, 2003 (WO) ..... 03/059777

(51) Int. Cl.
*B65D 41/32* (2006.01)
*A47G 19/22* (2006.01)

(52) U.S. Cl. ..... 220/266; 220/709; 229/103.1; 215/388

(58) Field of Classification Search ..... 220/705, 220/707, 709, 265, 266; 215/388; 229/103.1
See application file for complete search history.

(56) References Cited

U.S. PATENT DOCUMENTS 3,171,580 A * 3/1965 Davis et al. ..... 229/404
4,714,173 A 12/1987 Ruiz
5,054,684 A * 10/1991 Farber et al. ..... 229/103.1
5,201,460 A 4/1993 Caines
5,303,838 A 4/1994 Luch et al.
5,348,217 A * 9/1994 Bettle et al. ..... 229/103.1
5,782,344 A 7/1998 Edwards et al.
5,860,743 A * 1/1999 Larkin et al. ..... 383/104
5,947,323 A 9/1999 Freek et al.
6,032,812 A * 3/2000 Lamoureux ..... 215/303
6,116,782 A * 9/2000 Arkins et al. ..... 383/202
2003/0192889 A1* 10/2003 Chasteen et al. ..... 220/254.3
2003/0213803 A1* 11/2003 Chasteen et al. ..... 220/229

FOREIGN PATENT DOCUMENTS

JP 09323377 A * 12/1997

* cited by examiner

*Primary Examiner*—Anthony D. Stashick
*Assistant Examiner*—James Smalley
(74) *Attorney, Agent, or Firm*—Andrus, Sceales, Starke & Sawall, LLP

(57) ABSTRACT

A sealing device (2, 2', 2") to be arranged between an opening in a drinking container (1', 1") and a drinking straw (20), and a method of making the sealing device (2, 2', 2"). The sealing device (2, 2', 2") comprises a region of the drinking container (1', 1"), or a part connected to the drinking container (1', 1"), made from a material (14) subjected to a plastic deformation in a portion spanning said opening in the drinking container (1', 1"). The deformation has the form of a bulge (2*a*) of thinned material (4). The bulge (2*a*) is folded upon itself to form a ring-shaped fold (12) on the inside of the drinking container (1', 1"). The fold (12) encircles the plastically deformed and thinned wall material (4) of bulge (2*a*), said bulge material (4) forming an inner seal ring (19) around the drinking straw (20) when the bulge material (4) is perforated.

9 Claims, 3 Drawing Sheets

SEALING DEVICE FOR A DRINKING CONTAINER

CROSS REFERENCE TO RELATED APPLICATION

The present application is a continuation application of International Patent Application PCT/NO03/00010 designating the United States, filed Jan. 15, 2003, and published as International Publication No. WO 03/059777 on Jul. 24, 2003. The International Application claims the priority of Norwegian Application 20020302, filed Jan. 21, 2002.

BACKGROUND OF THE INVENTION

This invention concerns a simple and reliable sealing device to be arranged between an opening of a drinking container and a drinking straw, for example between an opening in a drinking bag and a drinking straw. The invention also concerns a method of making said sealing device. The present sealing device provides a good indication of the insertion hole for the straw in the drinking container; a reinforcement of the rim of the insertion hole; and also a thickness reduction, hence a weakening, of the container material spanning said insertion hole when unopened. This simplifies insertion of the drinking straw into the drinking container.

Several devices and methods of establishing a connection between a drinking container and a drinking straw are known in the art. These, however, are not particularly well-suited in providing both a physical connection and an adequate seal without having to add further materials, including plastics, cardboard, metal, glue or similar.

SUMMARY OF THE INVENTION

The object of the invention is to remedy said disadvantages of prior art.

The object is achieved in accordance with features disclosed in the following description and in subsequent claims.

According to the invention, the object is achieved by forming a region of a drinking container, or by forming a part connected to the drinking container, with a seal in the form of a bulge spanning said insertion hole, see FIG. 1. The container may be made from plastics or from two or more material layers having different properties, such as a plastics-coated foil, for example. This is accomplished by stretching the original wall material mechanically and/or thermally, thus reducing the material thickness of the bulge region. The bulge then is compressed to form a relatively flat and ring-shaped fold around the rim of the bulge, see FIG. 2. Thus, the seal obtains a shape and a size that does not occupy much space and is well-suited for production, packing and handling of the drinking container. The compressed bulge provides increased resilience to the seal and good definition of the size and compressive force of the seal. The inner rim of the fold forms a reinforcement and a proper support of the seal when a drinking straw is forced through the seal and into the drinking container, see FIG. 3. Reinforcement of the inner rim may be accomplished by attaching all or parts of the inner surfaces of the fold to each another. Moreover, the reduced material thickness of the bulge weakens the seal in the bulge region, thereby facilitating perforation of the seal when inserting the drinking straw into the drinking container. To ensure a best possible seal around the drinking straw, the inner rim of the fold should be of approximate circular shape and should accommodate the specific straw dimension.

When inserting the drinking straw and perforating the seal spanning the insertion hole, two seals are formed against the outside of the drinking straw, see FIG. 3, comprising:

An inner, flexible seal ring consisting of the bulge material encircling the perforation in the seal; and An outer, stiffer seal ring consisting of the inner rim of the fold.

The seal material spanning the insertion hole may incorporate a pre-stamped pattern that further facilitates the insertion of the drinking straw, simultaneously providing a better-defined sealing surface. The pattern may be in the shape of a circle, a star, a cross or any other suitable shape serving the purpose. Inasmuch as the present sealing device comprises two seal rings, resistance to withdrawal of the drinking straw is significantly increased, see FIG. 4. Using a drinking straw provided with a friction-promoting outer surface may increase this resistance further. Inasmuch as said seal material may be a part of the drinking container, said seal material may also be made from two or more material layers having different properties.

BRIEF DESCRIPTION OF THE DRAWINGS

The following describes the present method and a non-limiting example of an embodiment of a sealing device made according to this method. The invention is illustrated in the accompanying drawings, in which.

DETAILED DESCRIPTION OF THE INVENTION

Figure 1:
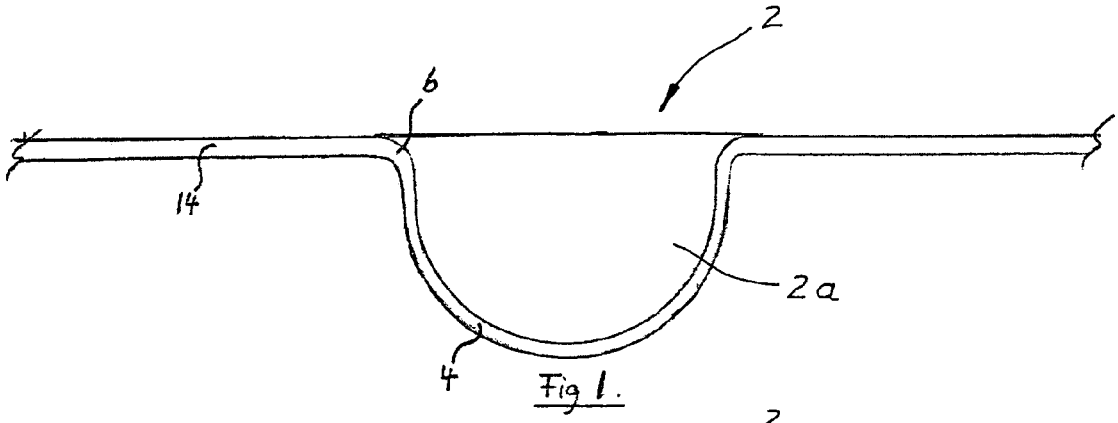
FIG. 1 shows the first step of the method of making a sealing device between a drinking container and a drinking straw.

FIG. 1 shows the first step of the present method of making a sealing device 2 according to the invention. A region of a sealing material 14 for a drinking container (not shown) is subjected to a plastic deformation causing a bulge 2*a* to form in sealing material 14. The transition between sealing material 14 and its bulge 2*a* defines an insertion hole in the drinking container. Due to said plastic deformation, material 4 in bulge 2*a* becomes thinner than sealing material 14 outside of bulge 2*a*. Hence, the strength of material 4 in bulge 2*a* is weakened, thereby making material 4 better suited for insertion of a drinking straw 20 than that of the other container material 14 having ordinary thickness.

Figure 2:
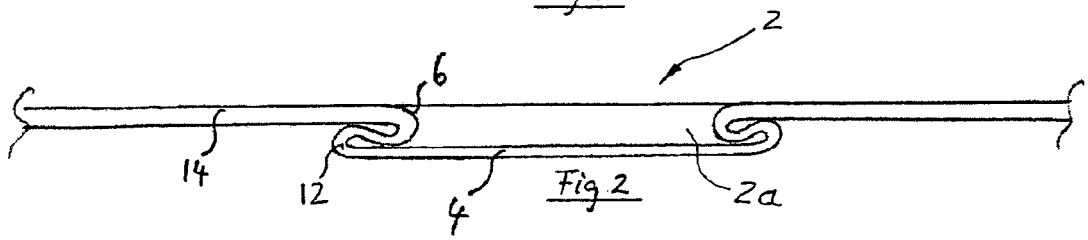
FIG. 2 shows the second step of the method.

FIG. 2 shows the second step of the method. Here, material 4 around the outer rim of bulge 2*a* is compressed to form a flat and folded seal ring 12 on the inside of sealing material 14 and its imperforated insertion hole. Thus, an outer seal ring 6 is formed around said insertion hole, forming an outer portion of folded seal ring 12. The inner portion of folded seal ring 12 is connected to a non-folded portion of bulge 2*a*, forming a tight internal seal spanning said insertion hole.

Figure 3:
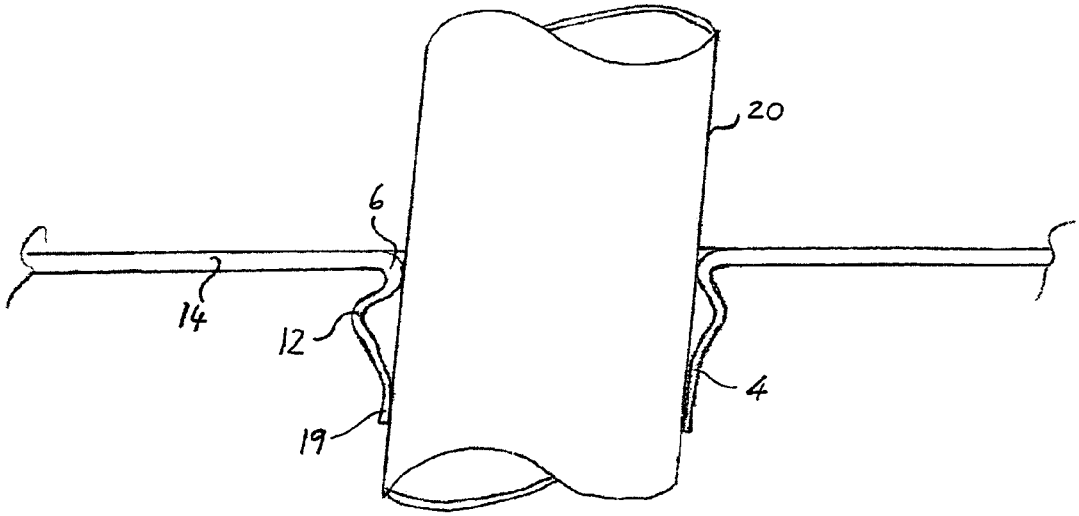
FIG. 3 shows the present sealing device after insertion of the drinking straw.

FIG. 3 shows sealing device 2 after perforation and insertion of drinking straw 20 through sealing device 2. Accordingly, a ring-shaped rupture region is formed in bulge 2*a*. Plastic material 4 around the rupture region tightens around drinking straw 20 and forms a flexible, inner seal ring 19. Simultaneously, said outer seal ring 6 forms a seal around drinking straw 20 at the insertion hole of the drinking container. As seal ring 12 is folded and has a predetermined peripheral shape that is complementary to the outer shape of drinking straw 20, outer seal ring 6 forms a stiffer seal against drinking straw 20 than that of the softer, inner seal ring 19. Hence, two ring-shaped seals 6, 19 encircle drinking straw 20, collectively forming a simple and reliable seal between the drinking container and drinking straw 20. To reinforce the inner rim of seal ring 12, all or parts of the inner surfaces thereof may be attached to each another.

Figure 4:
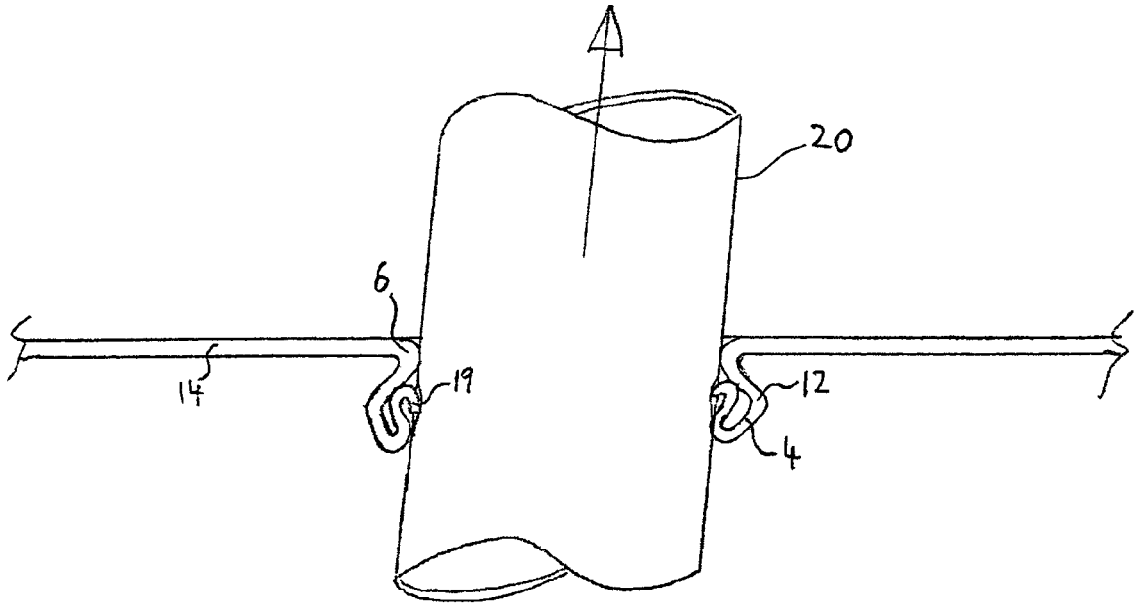
FIG. 4 shows an expected deformation shape of an inner seal ring when attempting to withdraw the drinking straw.

FIG. 4 shows cooperation between the inner, flexible seal ring 19 and the outer, stiffer seal ring 6 when attempting to withdraw drinking straw 20, said cooperation providing additional withdrawing resistance. During said withdrawing attempt, flexible seal ring 19 is pulled along in the movement outwards. Due to the flexibility thereof, seal ring 19 is folded together and becomes firmly wedged underneath the stiffer seal ring 6, thereby resisting unintended withdrawing of drinking straw 20. Providing drinking straw 20 with a friction-promoting outer surface may further enhance this effect.

Figure 5:
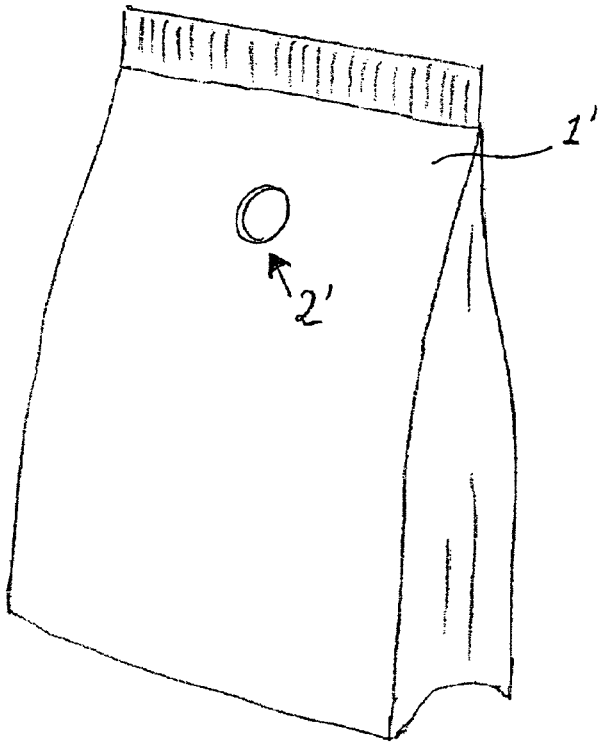
FIG. 5 shows the sealing device attached to a drinking bag.

FIG. 5 shows a sealing device 2' according to the invention placed on a drinking bag 1' made from plastics material. Device 2' is integrated directly into the plastics material of drinking bag 1'.

Figure 6:
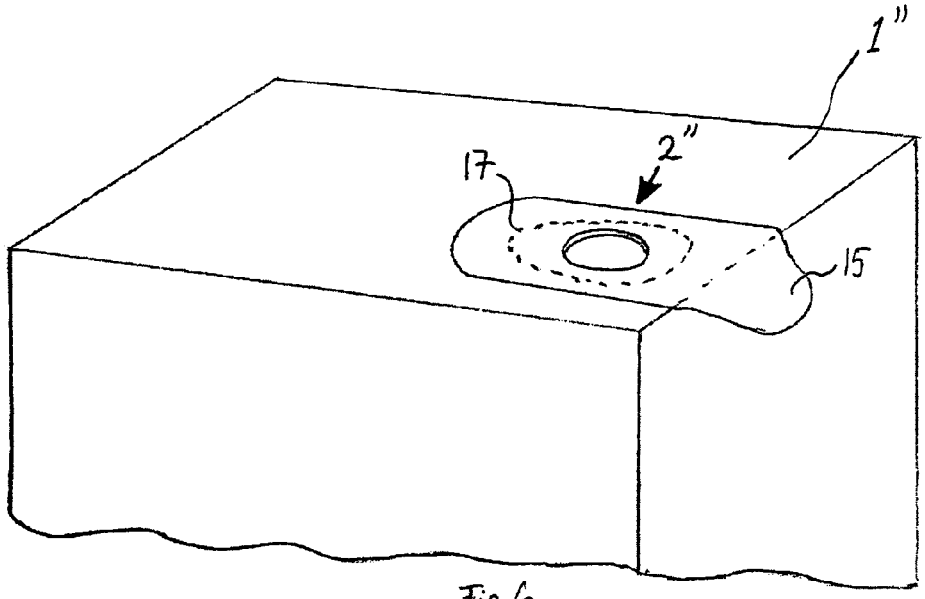
FIG. 6 shows the sealing device attached to a drinking carton.

FIG. 6 shows a sealing device 2" provided to a removable seal 15 attached on the outside of a drinking carton 1". Underneath seal 15, carton 1" is provided with a drinking opening 17 to be used if the content of drinking carton 1" is to be consumed without using a drinking straw. In the latter case, seal 15 is torn loose from carton 1", and the contents thereof is drained therefrom. Preferably, removable seal 15 is made from plastics or plastics-coated foil. If seal 15 is not torn loose from carton 1", a drinking straw may be inserted through sealing device 2", after which the contents in carton 1" may be consumed spill-free through the drinking straw.

The invention claimed is:

1. A sealing device for a drinking container or for a part configured for connection to a drinking container, said sealing device comprising:

a plastically deformable material comprising a portion that is plastically deformed so as to form a bulge of thinned wall material that spans said portion of the plastically deformable material, said sealing device defining an opening for a drinking straw when the drinking straw is inserted through the bulge of thinned wall material;

wherein the bulge of thinned wall material is folded upon itself to form a ring-shaped fold on the inside of the drinking container or the part configured for connection to the drinking container;

wherein the fold encircles the plastically deformed and thinned wall material of the bulge, said bulge of thinned wall material forming an inner seal ring around the drinking straw when the bulge of thinned wall material is perforated by the drinking straw;

wherein an outer seal ring of the fold is reinforced by attaching all or parts of the inner surfaces of the fold to each other.

2. The sealing device according to claim 1, wherein the outer seal ring encompasses the drinking straw when the drinking straw is inserted through the device.

3. The sealing device of claim 1, wherein the inner seal ring is more flexible than the outer seal ring.

4. The sealing device of claim 1, wherein the inner and outer seal rings together increase resistance to withdrawal of the drinking straw.

5. The sealing device of claim 4, wherein during withdrawal of the drinking straw from the sealing device, the inner seal ring folds together with the outer seal ring to increase resistance to withdrawing of the drinking straw.

6. The sealing device of claim 1, wherein the device comprises part of a drinking bag.

7. The sealing device of claim 1, wherein the device comprises part of a drinking carton.

8. The sealing device of claim 1, wherein the device comprises a removable seal for attachment to a drinking opening on the drinking container.

9. The sealing device according to claim 1, wherein the material of the sealing device is made from two or more material layers having different properties.

* * * * *